US006409790B1

(12) United States Patent
Calderon et al.

(10) Patent No.: US 6,409,790 B1
(45) **Date of Patent: *Jun. 25, 2002**

(54) METHOD AND APPARATUS FOR PRACTICING CARBONACEOUS-BASED METALLURGY

(75) Inventors: Albert Calderon; Terry James Laubis, both of Bowling Green, OH (US)

(73) Assignee: Calderon Energy Company of Bowling Green, Inc., Bowling Green, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/808,963

(22) Filed: Mar. 16, 2001

(51) Int. Cl.[7] ..... C21B 13/14

(52) U.S. Cl. ..... 75/10.12; 75/500; 75/501; 75/502; 75/503; 75/553; 75/486; 75/378; 75/10.14; 75/10.15; 266/89; 266/149; 373/140

(58) Field of Search ..... 75/486, 500, 501, 75/502, 503, 553, 10.12, 10.14, 10.15, 378; 266/144, 89, 149; 373/140

(56) References Cited

U.S. PATENT DOCUMENTS 6,214,085 B1 * 4/2001 Calderon et al. ..... 75/486
6,221,123 B1 * 4/2001 Mann Sr ..... 75/10.15

* cited by examiner

*Primary Examiner*—Melvyn Andrews
(74) *Attorney, Agent, or Firm*—Marshall & Melhorn, LLC

(57) ABSTRACT

An energy efficient, coal-based method and apparatus that are environmentally friendly which produce under pressure metallized/carbon product and molten metal directly from abundant coal or other carbonaceous material, and low cost fines (or ore concentrate) wherein the metal is devoid of gangue material and possesses the inherent advantage of retaining the heat for subsequent processing. This method and apparatus which are modular and highly integrated significantly reduce capital and operating costs; they also provide the capability selective placement of the reductant for the delivery of high levels of thermal energy input which leads to ease of desulflurization and high productivity. The technology herein disclosed is entirely closed and is applicable to various ores including ferrous and non-ferrous.

56 Claims, 3 Drawing Sheets

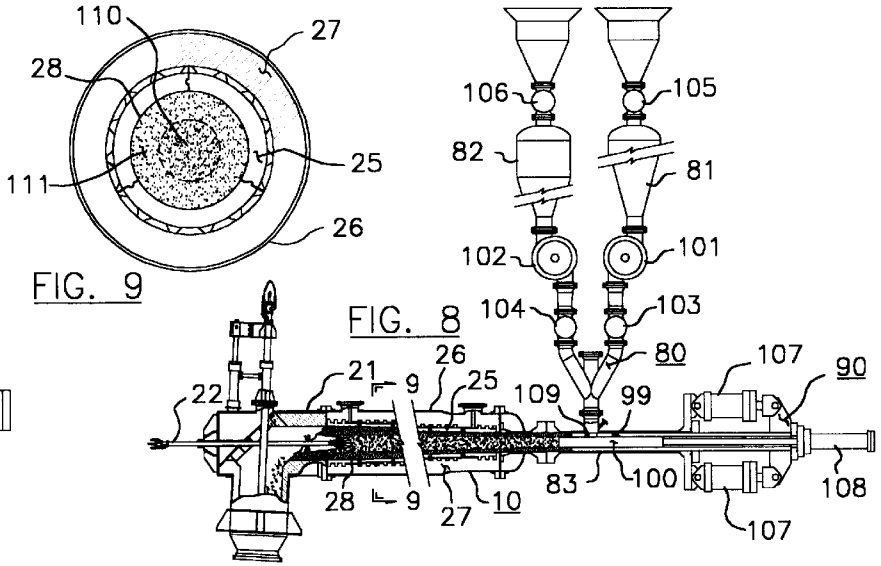
FIG. 8
FIG. 9
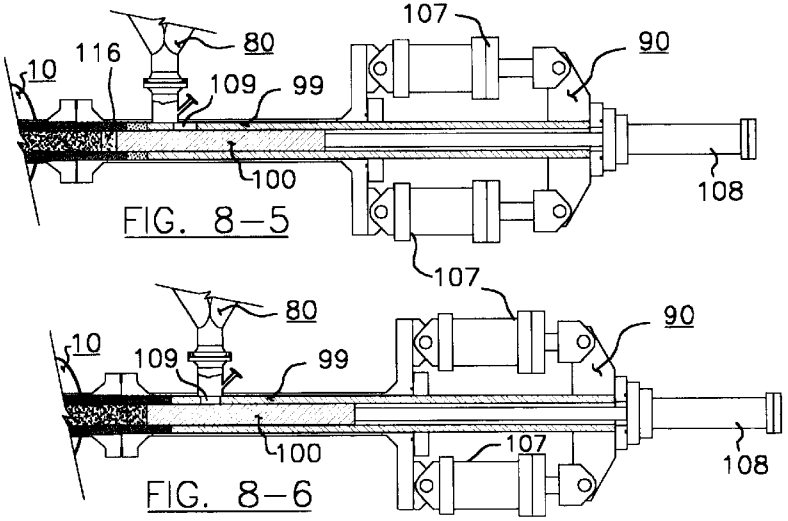
FIG. 8–5
FIG. 8–6
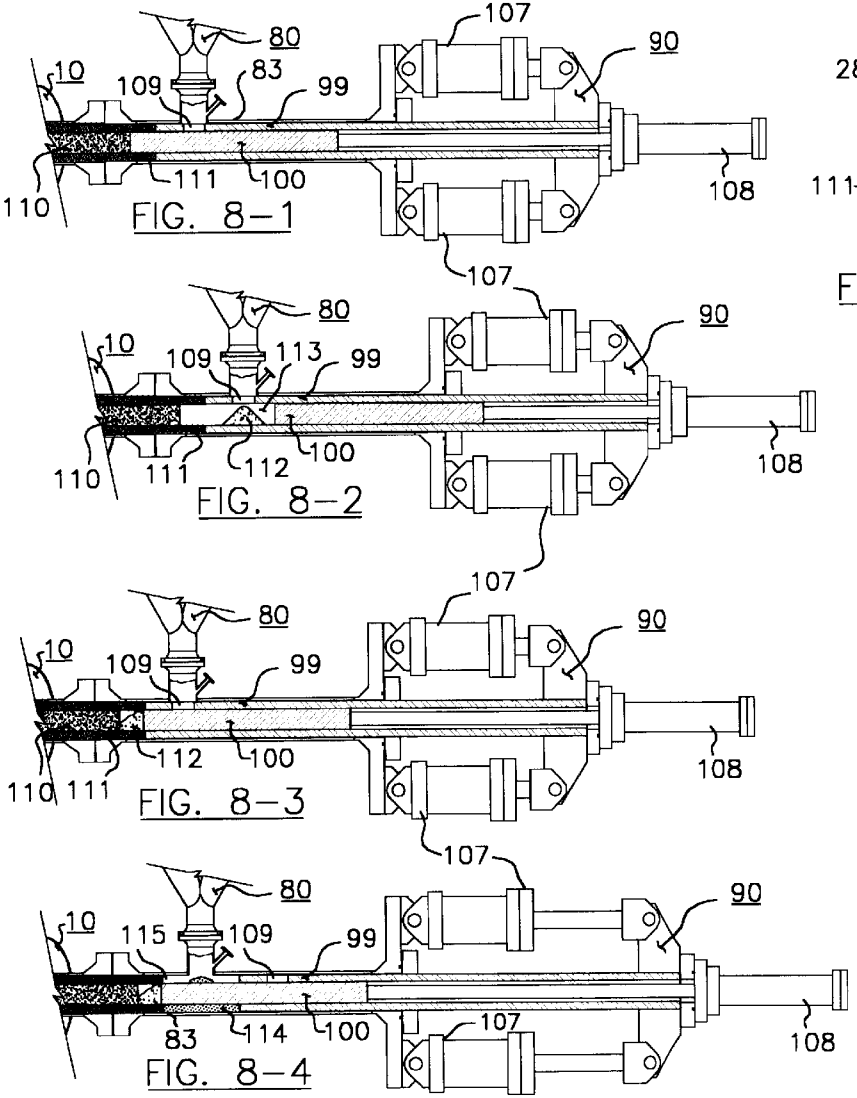
FIG. 8–1
FIG. 8–2
FIG. 8–3
FIG. 8–4

METHOD AND APPARATUS FOR PRACTICING CARBONACEOUS-BASED METALLURGY

INTRODUCTION

This invention relates to the production of metals from metallic oxides by making use of a carbonaceous material in furtherance of the disclosure contained in applicants' pending application bearing Ser. No. 09/241,649 filed on Feb. 1, 1999 now U.S. Pat. No. 6,214,085 and assigned to Art Unit 1742. Specifically this invention incorporates further developments to the subject matter disclosed in the referenced application particularly with respect to the feeding of raw materials, the heating of same, and reacting these raw materials with one another. Also additional developments are herein disclosed with respect to melting and slagging operations in order to provide an efficient integrated process and apparatus to practice same that are environmentally friendly and cost-competitive in the production of metals.

BACKGROUND

It is well known that existing methods to process raw metallic materials into ferrous and non-ferrous products are inefficient, polluting and very costly to finance, to operate and to maintain. Further, there are issues which relate to health hazards that affect workers in these fields by virtue of exposure to extremely high temperatures, and inhalation of injurious dusts and foul gases.

The method and apparatus disclosed herein have applicability to the processing of various metallic ores such as ores of iron, aluminum, copper, etc. including dusts, wastes and reverts of such metallic materials. Since iron ore is such a dominant feedstock in the field of metallurgy, by way of example, the disclosure in this application will focus on the processing of iron ore termed "carbotreating" with a carbonaceous material such as coal to produce an iron/carbon product which is melted with an oxidant termed "oxymelting" to make a molten iron.

OBJECTIVE OF THE INVENTION

The main object of this development is to provide a method and apparatus which are energy efficient to reduce greenhouse gases.

Another object of the instant invention is to provide a method and apparatus that are environmentally closed which will allow ease of permitting and acceptance by various entities including environmental protection agencies and the public.

Still another object of this invention is to provide a functionally efficient method and apparatus to practice same in order to produce a low cost product to enable industry to survive in a competitive global market.

Further still another object of this invention is to provide a method and apparatus that require low capital investment to enable industry to finance facilities and create jobs.

Further yet another object of this invention is to provide a method and apparatus that are not injurious to employees both from the standpoint of hazardous working conditions and long term deleterious effects regarding health.

Other objects of this invention will appear from the following description and appended claims. Reference is made to the accompanying drawings which describe certain apparatus structures to practice this method of making metallic units, and as they relate to making iron in the form of directly reduced iron, hot briquetted iron, iron/carbon product and molten iron. The molten iron may subsequently be converted into steel directly while molten or cast into pigs which are cooled and then transported as a solid to a processing plant. It is to be understood that the method and apparatus disclosed herein are not solely limited to the processing of iron bearing materials.

BRIEF DESCRIPTION OF THE DRAWINGS

FIG. 8 is a representation of the feed of materials into the system with sequential steps 8-1 through 8-6 showing various positions of the equipment to effect the feed wherein a core of fuel is created and such core is surrounded by the ore to be reduced.

FIG. 9 is a section taken at 9—9 of FIG. 8.

Before describing in detail the present invention, it is to be understood that this invention is not limited to the details or the arrangement of the parts illustrated in the attached drawings, as the invention can be made operative by using other embodiments. Also it is to be understood that the terminology herein contained is for the purpose of description and not limitation.

DETAILED DESCRIPTION OF THE DRAWINGS

Figures 1, 2, 3:
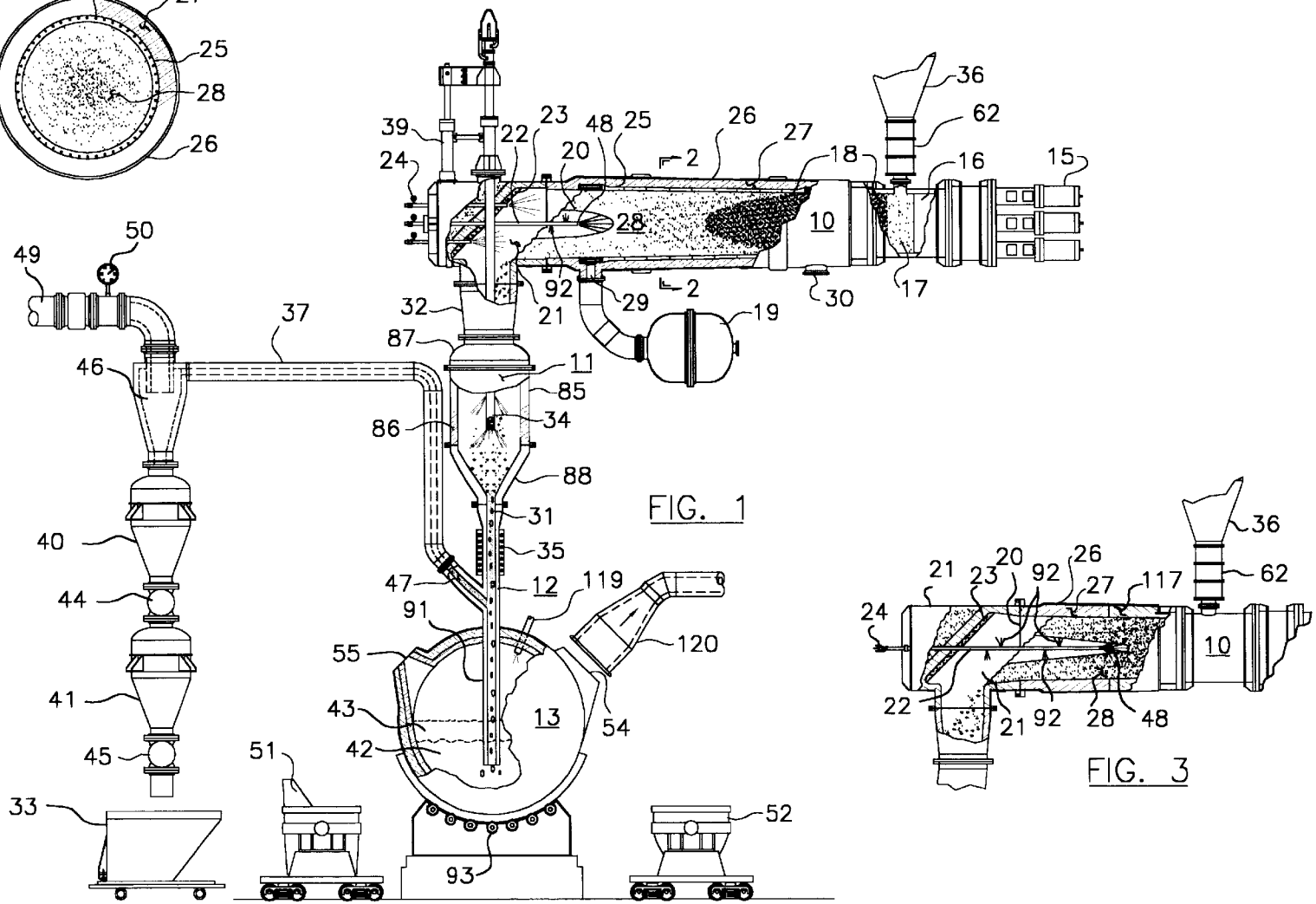
FIG. 1 is a representation of the equipment used to carry out the method to make a metallized/carbon product which is then melted to make molten metal.
FIG. 2 is a section taken at 2—2 of a reactor shown in FIG. 1, within which the carbotreating takes place.
FIG. 3 is a variation of the reactor chamber shown in FIG. 1.
Figure 4:
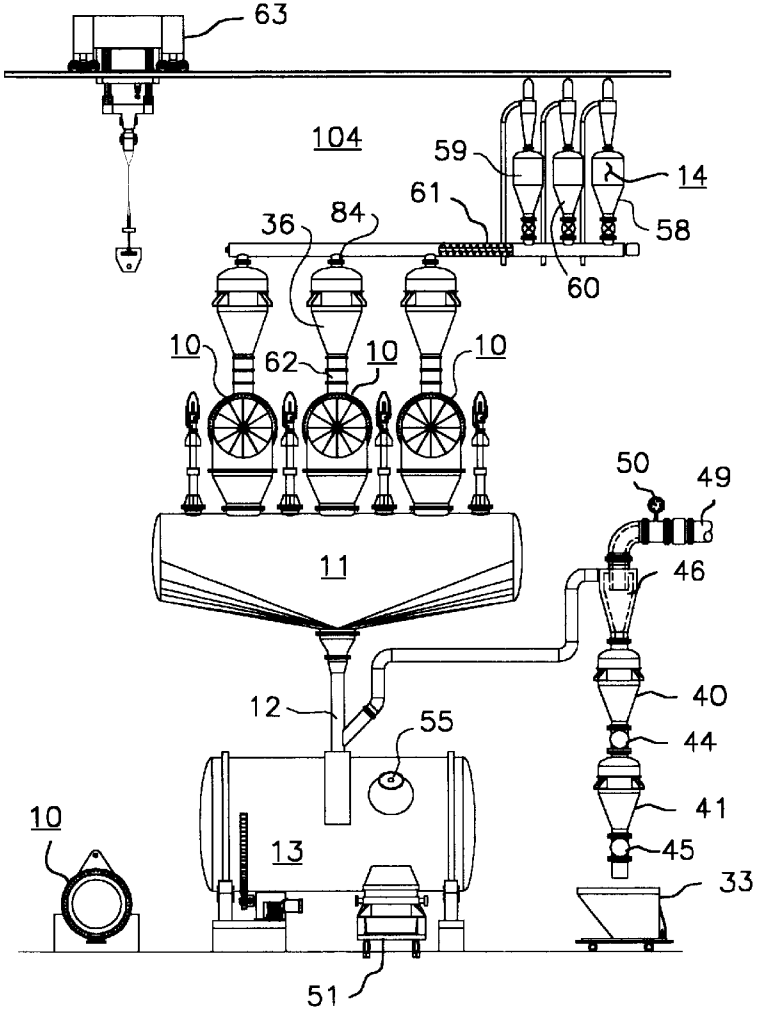
FIG. 4 is an end view of FIG. 1, showing a plurality of reactors discharging into a single melter/homogenizer.

Referring to FIG. 1, numeral 10 denotes a reactor where the treating of iron ore with coal takes place to make an iron/carbon product; this treatment of the ore is hereinafter referred to as "carbotreating". Numeral 11 denotes a melter/homogenizer where the iron/carbon product is melted with an oxidant to make molten metal and slag, hereinafter referred to as "oxymelting". A standpipe denoted by numeral 12 is connected to melter/homogenizer 11. A metal reservoir is provided for receiving the molten metal and the slag and is denoted by numeral 13. Referring to FIG. 4, a storage system to contain the raw materials is denoted by numeral 14; it comprises hoppers 58, 59 and 60 to store feed materials such as ore, coal and flux respectively. A raw material mixer denoted by numeral 61 serves to blend the feed materials as they are conveyed to lockhopper 36 which is in turn equipped with upper valve 84 and lower feed control 62.

Referring back to FIG. 1 for a more detailed description of the structure that enables the method to be practiced, reactor 10 consists of a pushing device denoted by numeral 15 which is equipped with ram 16 at the charging end of reactor 10, that serves to push the blended charge dropped from hopper 36 into cavity 17. Ram 16 actuated by pushing device 15, compresses the charge and advances it within a process chamber which is marked by numeral 28 and which is tapered along its length. Process chamber 28 is connected to cavity 17, and is made-up of a pressure shell marked by numeral 26, insulation 27 and wall heating element 25. Burner 19 in turn communicates with heating element 25 via inlet port 29. Heating element 25 is equipped with passages shown by numeral 53 in FIG. 2; they serve as a conduit to direct hot gases from burner 19 through inlet 29 to flow through passages (flues) 53 along the length of process chamber 28 and exit the chamber via outlet 30. The discharging end of chamber 28 which is marked by numeral 20 attaches to elbow 21. Elbow 21 is designed in such a way as to have reflective wall 23 backed by insulation and contained within a pressure casing, in order to form a radiant zone to reflect intense thermal energy against the material that is being carbotreated at discharging end 20. A first lance (or a plurality of same) denoted by numeral 22 is mounted into elbow 21; lance 22 is adapted to be advanced towards or retracted from the material being processed. Controller 24 serves to control air/oxygen and coolant to make lance 22 operative. Lance 22 may also contain fuel for start-up purposes.

Reactor 10 communicates with melter/homogenizer 11 by means of transition 32 that directs the reduced material (the iron/carbon product) from chamber 28 to melter/homogenizer 11 which comprises shell 85, lining 86, top 87 and bottom 88. A second lance denoted by numeral 34 serves to supply oxidant in the form of air or oxygen (or a combination of the two) in order to react with the carbon in the iron/carbon product and with gases produced within the process to supply the heat needed to melt the reduced iron in the iron/carbon product to yield a molten iron 42 and a molten slag 43 which floats on top of molten iron 42. Lance 34 which is kept cool, is raised and lowered by means of hoist 39 for adjusting its level to the working height within melter/homogenizer 11. A drain/port denoted by 31 and disposed at the bottom of melter/homogenizer 11, connects to standpipe 12. Through drain/port 31, the gasses, the molten iron and the molten slag flow. An off-gas discharge marked by numeral 47 is provided to standpipe 12 to divert a sidestrearn of such gases for control purposes which are directed to cyclone 46 via collecting main 37. Both the molten iron and the molten slag drop into reservoir 13 while the bulk of the gases flows with the iron and slag. Cyclone 46 communicating with discharge 47, removes particulate matter from the off-gas. The bottom of cyclone 46 is furnished with surge hopper 40 which feeds into lockhopper 41; control valves 44 and 45 lock & unlock lockhopper 41 in order to discharge the particulate matter collected into bin 33 which is recycled with the materials charged into reactor 10. A pressure controller denoted by numeral 50 which controls the back pressure of melter/homogenizer 11 and reactor 10 and standpipe 12 is located downstream of cyclone 46; the side stream leaves the system via duct 49 for further treatment in a gas treatment facility which is not shown, but known in the art.

Bottom 88 of melter/homogenizer 11 is configured as a cone with drain/port 31 making connection with standpipe 12 which in turn makes connection with metal reservoir 13 in a submerged mode. Induction heating coil means denoted by numeral 35 is provided, to supply auxiliary heat to insure that molten metal and molten slag do not freeze when leaving melter/homogenizer 11. In the event such freezing takes place especially when melter/homogenizer 11 is shut down, induction heating means 35 is energized to melt the frozen iron and slag. The lining of standpipe 12 is made of such material that would couple with induction heating means 35. Metal reservoir 13 consists of a lined chamber adapted to rotate about roller segment bed 93 to effect the pouring of molten iron 42 via tap hole 55 into ladle 51, and slag 43 via spout 54 into pot 52.

Referring to FIG. 3, numeral 10 is a modified configuration wherein heating element 25 along the length of chamber 28, is obviated. In this configuration the heat input is via lance 22 which is adapted to bore into bed 28 by means of an oxidant after ignition takes place. Lance 22 is equipped with an injection tip denoted by numeral 48 which may have multi-directional nozzles to inject oxidant in several directions. Auxiliary oxidant orifices shown by numeral 92 are provided to lance 22 to combust coal and coke in the mixture, as well as gases generated from the coal in the charge. Heating chamber 28, may be made as a composite structure of which part is metallic as noted by numeral 117 and part refractory as noted by numeral 27.

Referring again to FIG. 4 which is a configuration wherein a plurality of reactors such as reactor 10, are mounted side by side to form a battery denoted by numeral 104, with reactors 10 discharging iron/carbon product into common melter/homogenizer 11. Reactor 10 which is situated at ground level serves as a spare. A crane denoted by numeral 63, may be added to service battery 104.

Figure 5:
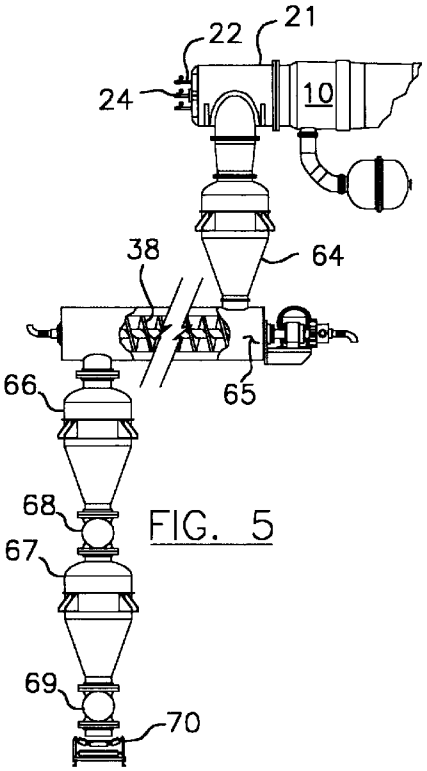
FIG. 5 is a configuration to produce directly reduced iron units and cooling such units before discharge into the atmosphere.

In FIG. 5, the invention is configured to make directly reduced iron (DRI) or iron/carbon product which can be melted off-site. Numeral 10 is the reactor with a downstream surge hopper denoted by numeral 64 which is followed by cooler 65. Cooler 65 may take one of several known approaches including a cooled screw feeder shown by numeral 38. The cooler feeds the cooled DRI or iron/carbon product into surge hopper 66. Below surge hopper 66, a lockhopper denoted by numeral 67 makes possible the discharging of product DRI or iron/carbon product in a sealed manner into the atmosphere and onto conveyor 70 by making use of valves 68 and 69. A cyclone similar to cyclone 95 shown in FIG. 6 and described hereunder, may be used for separation of entrained particulate matter.

Figure 6:
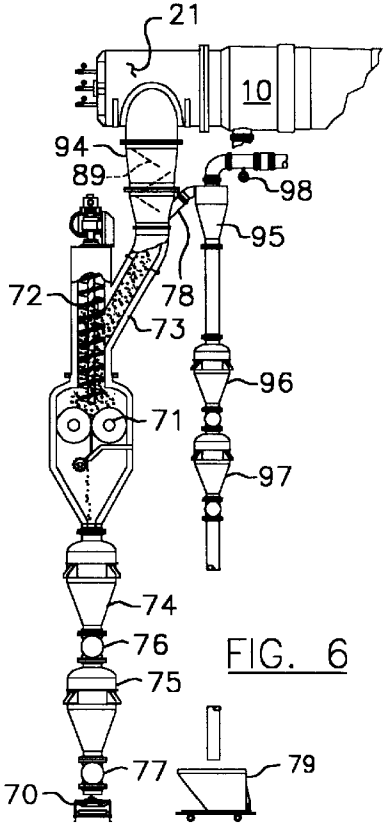
FIG. 6 is still another configuration to produce iron units which are brigquetted prior to their discharge into the atmosphere.

Referring to FIG. 6, numeral 10 is the reactor and numeral 21 is the elbow. Beneath elbow 21 a transition denoted by numeral 94 is provided through which the carbotreated material is discharged via downcomer 73 into hot-briquetter 71 which is adapted to form briquettes from the carbrotreated material. A screw feed denoted by numeral 72 is disposed upstream of briquetter 71 to control the feed into the briquetter. Beneath briquetter 71, surge hopper 74 followed by lockhopper 75 are provided to discharge the formed briquettes into the atmosphere and onto conveyor 70. Valves 76 and 77 serve to lock and unlock lockhopper 75.

Adjacent to transition 94, cyclone 95 is mounted by making use of pipe 78, in such a way as to pass hot gasses through cyclone 95 in order to remove particulate matter from the gasses. Transition 94 which is equipped with impact surfaces such as cascading baffles 89 tend to breakup the hot carbotreated material to release excess particulate matter; such matter which remains entrained in the off-gases, is disengaged in a cyclone denoted by numeral 95. Cyclone 95 is equipped with pressure control means 98, and surge hopper 96 is followed by lockhopper 97. Collecting bin 79 is disposed below lockhopper 97 for receiving the particulate matter removed from the gases, which is recycled (not shown).

Figure 7:
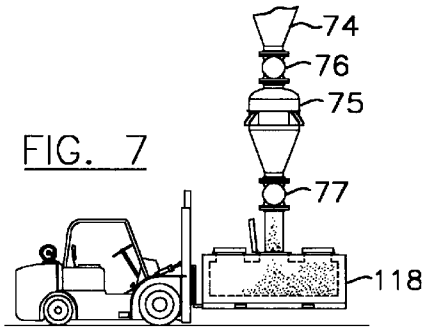
FIG. 7 represents discharging hot reduced metallic units into a container which is insulated and sealed to conserve energy and prevent re-oxidation.

Referring to FIG. 7, a box denoted by numeral 118 may be provided beneath lockhopper 75 to contain the iron/ carbon product and be transported by any one of known means such as a lift-truck for further processing. Box 118 is designed in such a way as to be insulated to accept hot product in order to conserve thermal energy and prevent re-oxidation of the product.

Reference is now made to FIG. 8 for the description of the structure to feed the carbonaceous material as a core which is surrounded by the metallic ore. A materials storage arrangement is provided and denoted by numeral 80 which comprises hopper 81 to contain the carbonaceous material (fuel) and hopper 82 to contain the ore. Feeders 101 and 102 control the flow of the fuel and ore from hoppers 81 and 82 respectively. Valves 103 and 105 service lockhopper 81 and valves 104 and 106 service lockhopper 82. Charging tube 83 is provided at the bottom of materials storage 80, which is flanked by charging device 90 on one side and reactor 10 on the other side. Charging device 90 is made up of a pushing ram denoted by numeral 99 and pushing plunger 100 with ram 99 being advanced and retracted by actuator means such as cylinders 107, and plunger 100 being advanced and retracted by actuator means such as cylinder 108 thus providing independent motion to either ram 99 or plunger 100, with plunger 100 being housed within ram 99 which is annular in configuration and which is in turn housed within charging tube 83. Ram 99 passes a charging hole 109 to permit the fuel to be dropped into a cavity when plunger 100 is in the retracted position. During the detailed description of the operation for the formation of the core which follows, further clarification will be disclosed with the aid of FIGS. 8-1 through 8-6.

DETAILED DESCRIPTION OF OPERATION

In explaining the operation of the method and apparatus disclosed herein, the description will be as follows:

(i) Mode of feeding ore and coal, and of heating such materials for carbotreating the ore to yield a metallized/carbon product; and (ii) Melting the metallized/carbon product to yield molten metal via oxymelting.

With respect to carbotreating wherein a core of fuel is formed in the charged metallic oxide (ore), reference is made to FIG. 8, its sequential FIGS. 8-1 through 8-6, and FIG. 9. In FIG. 8-1 both ram 99 and plunger 100 are shown in the advanced position with the core of fuel being denoted by numeral 110 and the oxide surrounding it being denoted by numeral 111. Plunger 100 is retracted to the position shown in FIG. 8-2 by means of cylinder 108 while retaining ram 99 in the advanced position. A metered amount of fuel (coal) marked by numeral 112 is dropped into cavity 113 via charging hole 109. Plunger 100 is then advanced part way to push fuel 112 towards that core of fuel which had been charged and compacted during the previous cycle as shown by FIG. 8-3. Next, ram 99 is retracted using the full stroke of cylinders 107 while plunger 100 is parked at the part way advanced position. A metered amount of oxide marked by numeral 114, is dropped into cavity 115 as shown by FIG. 8-4 which cavity surrounds plunger 100. Following this step both ram 99 and plunger 100 are simultaneously advanced; initially, the loose materials begin to be compacted as shown in FIG. 8-5 by numeral 116, and as the advancement of ram 99 and plunger 100 proceeds the fuel and the oxide become fully compacted with the core being formed within the oxide with the oxide fully surrounding the core of fuel; the stroke of both ram 99 and plunger 100 keeps advancing after compaction and the entire contents of reactor 10 begin to move to result in hot metallized/carbon product being discharged from the discharging end of reactor 10 as illustrated in FIG. 8; the discharge of such product stops when ram 99 and plunger 100 are fully stroked to the advanced position. At the end of the stroke of ram 99 and plunger 100, the relationship of the ram and the plunger is shown in FIG. 8-6 which is the same as that shown in FIG. 8-1. At this point the cycle is completed. The formation of a fuel core 110 proceeds cyclically to result in providing core 110 being surrounded by oxide 111 shown in cross section in FIG. 9. This repetitive cycle thus provides a core of fuel being surrounded with oxide along the length of chamber 28 of reactor 10.

The operation of carbotreating with reference to FIGS. 1, 3 and 4 is as follows:

Assuming that the method is already at steady state and at pressure, and the ore (preferably in fine, concentrated form), the coal and the flux contained in materials delivery system 14, are proportionately mixed and fed as a mixture via hopper 36, into cavity 17 of process chamber 28. Ram 16 is then actuated via pushing device 15 to compact the mixture to such an extent as to make it substantially impervious as shown by the densified representation (numeral 18) at the charging end of reactor 10. As the mixture is advanced in chamber 28 of reactor 10, it is heated by any of the following manners of heating; namely, radiation, conduction, convection or any combination of these systems to cause the evolution of gases from the coal with the imperviousness of the mixture forcing the gases to flow within chamber 28 towards discharging end 20. A portion of these gases is combusted at the discharging end to provide a highly radiant zone to reflect intensive thermal energy to the mixture to heat the mixture to such a temperature as to cause the oxygen in the ore to react with the highly reducing gases liberated from the coal and/or with residual carbon from the coal to reduce the ore to metallized iron. To enhance the heat transfer to the mixture, lances such as lance 22 are provided, which lances are adapted to inject an oxidant in the form of air, oxygen or a combination of both into the mixture of materials within chamber 28, as this mixture advances in chamber 28. Further these lances which are kept cool by means of a coolant are also adapted to be advanced and retracted for optimal heat transfer. Variations of oxidant lance injection may also take the form of penetration into the mixture itself as shown by FIGS. 1 and 3, with supplementary jets of oxidant (see number 92) for post-combustion to further enhance heat transfer into the mixture. In the event that no conductive heat through the wall of chamber 28 is furnished, lance 22 may take the form of an oxygen-fuel (coal, gas or oil) burner to initiate the combustion and with the provision that once ignition of the coal gases and the carbon in the coal becomes stable the fuel input from the lance is shut-off, and the coal and its gases supplying the thermal energy needed for sustaining the reactions thus producing the iron/carbon product which is discharged into melter/homogenizer 11. An alternate arrangement may be the supply of the fuel through lance 22 such as the injection of pulverized coal onto the ore or a combination of the arrangements described herein and others which are known in the art.

The iron/carbon product made by this method is relatively light as compared to the bulk density of iron ore and especially as compared to molten metal; further, the size of the iron/carbon product as it is discharged from reactor 10 is diverse in size and non-uniform. When such product is discharged into a melter containing molten metal and slag, the iron/carbon product tends to float on top of the slag and the molten metal causing delays in productivity and loss of energy by the inability to readily get the iron/carbon product into solution. It is for this purpose that a melter which also acts as a homogenizer devoid of a bath of molten metal and molten slag is provided which takes the form of melter/homogenizer 111 which is capable of draining the molten iron and molten slag as they are formed.

The oxymelting of the metallized/carbon product will now be described by making reference to FIG. 1. Within melter/homogenizer 11, lance 34 provides the oxidant to melt the hot iron/carbon product being fed from reactor 10 via downcomer 32. The oxidant reacts with gases and with carbon from the carbotreating step to cause an intensive energy release which melts the iron in the iron/carbon product, the gangue which was part of the iron oxide, the ash of the coal as well as the flux/desuilirizer material used as additive, to result in making a molten iron and a molten slag, this combination continuously leaves melter/homogenizer 11 via drain/port 31 together with the various hot, pressurized gases produced. Such gases flowing through drain/port 31 keep the molten iron and the slag flowing out of melter/homogenizer 11 and into reservoir 13 by making use of standpipe 12 whose tip is submerged in the molten metal within reservoir 13; this submergence provides a liquid seal which maintains the pressure in the system.

By means of control valve 50 the back pressure in reactor 10, melter/homogenizer 11 and standpipe 12 is balanced while the gases generated during carbotreating in reactor 10 and the gases generated during oxymehing in melter/homogenizer 11 are guided together with the molten metal and molten slag to reservoir 13 where such gases bubble out of the bath and are combusted for additional energy release by injecting an oxidant through nozzle 119. The off-gas is collected in hood 120 for treatment not shown but known in the art. The metallic dust, carbon and ash entrained in such gases remain in the bath by virtue of the bath serving as a wet scrubber which increases the yield of the molten metal. A side stream of such gases flowing through main 37, is used for pressure control by means of valve 50 and are directed to cyclone 46 via discharge 47 for treatment. The particulate matter separated in cyclone 46 is recycled with the feedstocks and auxiliary heat if needed, is maintained in standpipe 12 by means of induction heating 35. The operation in reactor 10 and in the melter/homogenizer 11 is intentionally maintained reducing to prevent re-oxidation of the iron and minimizing the formation of $NO_x$ and $CO_2$, while providing efficient desulfurizing conditions to remove the sulfur which originates from the coal.

With respect to the application of this invention to the non-ferrous metals, variations to that which is disclosed may take place; however, the intention is not to depart from the spirit of this disclosure. All in all, it is submitted herein that the instant invention provides major improvement over conventional practice/metallurgy, which can use low cost raw materials, and which is energy efficient, environmentally friendly and requiring low capital investment.

We claim:

1. A method for thermally processing a metallic oxide with a carbonaceous material in one or more chambers, wherein each of the one or more chambers has a charging end and a discharging end, to produce a hot metallized/carbon product which is subsequently melted in a melter to make a molten metal and a molten slag, comprising:

feeding the metallic oxide and the carbonaceous material to the charging end of said one or more chambers and forcing the metallic oxide and the carbonaceous material toward the discharging end of said one or more chambers;

injecting an oxidant in such a way as to utilize at least a portion of the energy contained in said carbonaceous material to release thermal energy and produce pressurized reducing gases to reduce the metallic oxide to form a hot metallized/carbon product;

discharging said hot metallized/carbon product from said one or more chambers into the melter;

heating the metallized/carbon product in the melter to produce a hot pressurized off-gas, a molten metal and a molten slag; and segregating the off-gas, the molten slag and the molten metal.

2. A method for thermally processing a metallic oxide with a carbonaceous material in one or more chambers, wherein each of the one or more chambers has a charging end and a discharging end, to produce a hot metallized/carbon product which is subsequently melted in a melter to make a molten metal and a molten slag, comprising:

feeding the metallic oxide and the carbonaceous material to the charging end of said one or more chambers in such a way as to form a core with an annulus surrounding the core for the efficient reaction of the metallic oxide with the carbonaceous material, and forcing the metallic oxide and the carbonaceous material toward the discharging end of said one or more chambers;

injecting an oxidant in such a way as to utilize at least a portion of the energy contained in said carbonaceous material to release thermal energy and produce pressurized reducing gases to reduce the metallic oxide to form a hot metallized/carbon product;

discharging said hot metallized/carbon product from said one or more chambers into the melter;

heating the metallized/carbon product in the melter to produce a hot pressurized off-gas, a molten metal and a molten slag; and segregating the off-gas, the molten slag and the molten metal.

3. The method set forth in claim 2 wherein the step of injecting an oxidant includes the injection of the oxidant into the discharging end of said one or more chambers.

4. The method set forth in claim 1 wherein a group of chambers are assembled together in battery form, with each chamber being a separate module for ease of scale-up and maintenance.

5. The method set forth in claim 1 wherein the heating of the metallized/carbon product in said melter comprises the step of consuming at least a portion of the carbon in said melter.

6. The method set forth in claim 1 further comprising, controlling pressure to maintain the steps of the method in balance.

7. The method set forth in claim 1 further comprising providing induction heating as supplemental heating to the melter.

8. The method set forth in claim 7 comprising adding an oxidant to supplement said induction heating.

9. The method set forth in claim 1 wherein the oxidant is substantially pure oxygen.

10. The method set forth in claim 1 wherein the oxidant comprises air.

11. The method set forth in claim 1 wherein the oxidant is air enriched with oxygen.

12. The method set forth in claim 1 further comprising providing a radiant heating zone downstream from the discharging end of said one or more chambers to reflect thermal energy towards the materials being processed in order to efficiently transfer heat by radiation to accelerate the conversion of said metallic oxide into a metallized/carbon product.

13. The method set forth in claim 1 further comprising heating said chamber by passing hot gases through flues provided in the wall of said chamber to additionally heat the materials in the chamber by conduction.

14. The method set forth in claim 1 wherein additional energy is introduced in said radiant zone by combusting gases therein to further accelerate the reduction of said metallic oxide.

15. The method set forth in claim 1 wherein the materials in said chamber are advanced and discharged from said chamber in such a way as to repeatedly provide a new face of the materials being processed at the discharging end of said chamber.

16. The method set forth in claim 1 further comprising guiding the molten metal and molten slag into a reservoir.

17. The method set forth in claim 16 further comprising guiding the molten metal and molten slag into a reservoir in a submerged mode to provide a liquid seal.

18. The method set forth in claim 1 wherein the method is environmentally closed to prevent polluting emissions.

19. The method set forth in claim 1 wherein said chamber includes a tapered portion that diverges towards the discharge end of said chamber.

20. The method set forth in claim 1 wherein the metallic oxide is comprised of an iron oxide.

21. The method set forth in claim 1 wherein the carbonaceous material is comprised of coal.

22. The method set forth in claim 1 further comprising guiding the molten metal and molten slag to a reservoir together with a flow of gases that are combusted to release thermal energy.

23. The method set forth in claim 1 further comprising homogenizing the molten metal in said melter.

24. The method set forth in claim 1 further comprising homogenizing the molten metal into iron.

25. The method set forth in claim 1 further comprising honogenizing the molten metal into steel.

26. The method set forth in claim 1 including the injecting of the oxidant by means of a lance.

27. The method set forth in claim 1 including the injecting of the oxidant by means of a plurality of lances.

28. The method set forth in claim 1 further comprising the addition of a flux material to the metallic oxide and carbonaceous material.

29. The method set forth in claim 1 further comprising the addition of a desulfturizing material to the metallic oxide and carbonaceous material.

30. The method set forth in claim 1 further comprising including at least a portion of said carbonaceous material in the metallic oxide to form a mix.

31. The method set forth in claim 1 further comprising charging said carbonaceous material into said chamber in such a way as to form a core of fuel.

32. The method set forth in claim 31 further comprising directing an oxidant towards said core of fuel from the discharging end of said chamber.

33. The method set forth in claim 32 wherein said oxidant penetrates said core of fuel.

34. A method for thermally processing a metallic oxide with a carbonaceous material in one or more chambers, wherein each of the one or more chambers has a charging end and a discharging end, to produce a hot metallized/carbon product which is subsequently melted in a melter to make a molten metal and a molten slag, comprising:

feeding the metallic oxide and the carbonaceous material to the charging end of said one or more chambers and forcing the metallic oxide and the carbonaceous material toward the discharging end of said one or more chambers;

injecting an oxidant in such a way as to utilize at least a portion of the energy contained in said carboniaceous material to release thermal energy and produce pressurized reducing gases to reduce the metallic oxide to form a hot metallized/carbon product;

discharging said hot metallized/carbon product from said one or more chambers into a container, discharging the metallized/carbon product from said container into a melter, and heating the metallized/carbon product in the melter to produce a hot pressurized off-gas, a molten metal and a molten slag; and segregating the off-gas, the molten slag and the molten metal.

35. The method set forth in claim 33 wherein said container helps to maintain the heat and prevent the re-oxidation of the metallized/carbon product.

36. The method set forth in claim 34 further comprising cooling the metallized/carbon product in said container prior to exposing the product to the atmosphere.

37. The method set forth in claim 33 wherein the metallized/carbon product is briquetted prior to its discharge into said container.

38. The method set forth in claim 36 wherein the briqtuetted metallized/carbon product is cooled prior to exposing the product to the atmosphere.

39. Apparatus for thermally processing a metallic oxide and carbonaceous material in one or more chambers comprising:

a reactor including a heating chamber having a charging end and a discharging end;

a feeding device for feeding the metallic oxide and the carbonaeous material into the charging end of said chamber and forcing the metallic oxide and the carbonaceous material toward the discharging end of said chamber;

oxidant injection means adapted to inject an oxidant to cause the carbonaceous material to rise in temperature and react with the metallic oxide to form a metallized/carbon product;

a melter in communication with the discharging end of said chamber adapted to receive the metallized/carbon product from said chamber, said melter being adapted to heat the metallized/carbon product to produce a hot pressurized off-gas, molten metal and molten slag; and means for segregating the off-gas, molten slag and molten metal.

40. The apparatus set forth in claim 38 further comprising a reservoir for accepting molten metal and molten slag from said melter.

41. The apparatus set forth in claim 40 further comprising a reservoir for accepting molten metal and molten slag from said melter in a submerged mode.

42. The apparatus set forth in claim 40 wherein said reservoir is adapted to tap the molten metal separately from the molten slat.

43. The apparatus set forth in claim 39 wherein said chamber includes a radiant zone adapted to radiate thermal energy towards the discharging end of said chamber.

44. The apparatus in claim 39 further comprising pressure balancing means adapted to balance system pressure.

45. The apparatus in claim 38 wherein said oxidant injection means is adapted to be selectively advanced or retracted.

46. The apparatus in claim 39 further comprising oxidant injection means operatively connected with said melter.

47. The apparatus set forth in claim 39 further comprising induction heating means operatively connected with said melter.

48. The apparatus in claim 39 further comprising means for supplying supplemental heat to said melter.

49. The apparatus in claim 48 wherein said means for supplying supplemental heat to said melter comprises an induction heating means.

50. The apparatus in claim 48 wherein said means for supplying supplemental heat to said melter comprises an oxidant injection means.

51. The apparatus set forth in claim 39 further comprising a combination oxidant injection means adapted to inject oxidant as well as fuel.

52. The apparatus set forth in claim 51 wherein said fuel is gas.

53. The apparatus set forth in claim 51 wherein said fuel is pulverized coal.

54. Apparatus for thermally processing a metallic oxide and carbonaceous material in one or more chambers comprising:

a reactor including a heating chamber having a charging end and a discharging end;

a feeding device for feeding the metallic oxide and the cabonaceous material into the charging end of said chamber as a core with a surrounding annulus, and forcing the metallic oxide and the carbonaceous material toward the discharging end of said chamber;

oxidant injection means adapted to inject an oxidant to cause the carbonaceous material to rise in temperature and react with the metallic oxide to form a metallized/carbon product;

a melter in communication with the discharging end of said chamber adapted to receive the metallized/carbon product from said chamber, said melter being adapted to heat the metallized/carbon product to produce a hot pressurized off-gas, molten metal and molten slag; and means for segregating the off-gas, molten slag and molten metals.

55. The apparatus set forth in claim 54 further comprising means for the formation of said core from the carbonaceous material with the metallic oxide surrounding said core.

56. The apparatus set forth in claim 54 further comprising oxidant injection means adapted to direct the oxidant into said core.

* * * * *

UNITED STATES PATENT AND TRADEMARK OFFICE

CERTIFICATE OF CORRECTION

PATENT NO. : 6,409,790 B1 
DATED : June 25, 2002
INVENTOR(S) : Albert Calderon and Terry James Laubis It is certified that error appears in the above-identified patent and that said Letters Patent is hereby corrected as shown below:

Title page,
Item [57], ABSTRACT,
Line 10, add -- for the -- after "capability" and before "selective".

Column 7,
Line 15, delete "desuilirizer", add -- desulfurizer --.
Line 28, delete "oxymehing", add -- oxymelting --.

Column 8,
Line 42, delete "1", add -- 2 --.
Line 46, delete "1", add -- 2 --.
Line 50, delete "1", add -- 2 --.
Line 53, delete "1", add -- 2 --.
Line 58, delete "1", add -- 2 --.
Line 60, delete "1", add -- 2 --.
Line 62, delete "1", add -- 2 --.
Line 64, delete "1", add -- 2 --.

Column 9,
Line 4, delete "1", add -- 2 --.
Line 8, delete "1", add -- 2 --.
Line 12, delete "1", add -- 2 --.
Line 17, delete "1", add -- 2 --.
Line 22, delete "1", add -- 2 --.
Line 24, delete "1", add -- 2 --.
Line 27, delete "1", add -- 2 --.
Line 29, delete "1", add -- 2 --.
Line 31, delete "1", add -- 2 --.
Line 35, delete "1", add -- 2 --.
Line 37, delete "1", add -- 2 --.
Line 39, delete "1", add -- 2 --.
Line 40, delete "honogenizing", add -- homogenizing --.
Line 41, delete "1", add -- 2 --.
Line 43, delete "1", add -- 2 --.
Line 45, delete "1", add -- 2 --.
Line 48, delete "1", add -- 2 --.
Line 51, delete "1", add -- 2 --.
Line 54, delete "1", add -- 2 --.

UNITED STATES PATENT AND TRADEMARK OFFICE

CERTIFICATE OF CORRECTION

PATENT NO. : 6,409,790 B1 
DATED : June 25, 2002
INVENTOR(S) : Albert Calderon and Terry James Laubis It is certified that error appears in the above-identified patent and that said Letters Patent is hereby corrected as shown below:

Column 10,
Line 19, delete “33”, add -- 34 --.
Line 24, delete “33”, add -- 34 --.
Line 27, delete “36”, add -- 37 --.
Line 51, delete “38”, add -- 39 --.
Line 59, delete “slat”, add -- slag --.
Line 65, delete “38”, add -- 39 --.

Signed and Sealed this

Fifth Day of November, 2002

*Attest:*

*Attesting Officer*

JAMES E. ROGAN
*Director of the United States Patent and Trademark Office*